US005873909A

United States Patent [19]

Brodmann et al.

[11] Patent Number: 5,873,909

[45] Date of Patent: Feb. 23, 1999

[54] METHOD AND COMPOSITIONS FOR TREATING FIBROUS CELLULOSIC MATERIALS

[75] Inventors: George L. Brodmann, Port St. Lucie; John S. Thackrah, Palm City, both of Fla.

[73] Assignee: Ducoa, L.P., Highland, Ill.

[21] Appl. No.: 56,135

[22] Filed: Apr. 7, 1998

Related U.S. Application Data

[63] Continuation-in-part of Ser. No. 867,132, Jun. 2, 1997, which is a continuation-in-part of Ser. No. 738,996, Oct. 29, 1996, abandoned.

[51] Int. Cl.[6] ..... D06P 5/13

[52] U.S. Cl. ..... 8/403; 8/493; 8/565; 8/566; 8/571; 8/573; 8/606; 8/182; 8/183; 8/185; 8/186; 8/189; 162/72; 162/74; 162/157.2; 252/8.61; 252/8.86

[58] Field of Search ..... 252/8.91, 8.86, 252/8.61; 8/491, 495, 565, 566, 571, 573, 550, 606, 181, 182, 403, 183, 185, 186, 189, 196, 493, 496, 537, 542, 543, 115.7; 162/72, 74, 87, 157.2, 157.3, 157.6, 197

[56] References Cited

U.S. PATENT DOCUMENTS

| | | | |
|---|---|---|---|
| 4,629,470 | 12/1986 | Harper, Jr. | 8/585 |
| 4,711,640 | 12/1987 | Harper, Jr. | 8/481 |
| 4,780,102 | 10/1988 | Harper, Jr. | 8/196 |
| 5,006,125 | 4/1991 | Patton et al. | 8/188 |
| 5,501,711 | 3/1996 | Weltrowski et al. | 8/543 |
| 5,593,618 | 1/1997 | Okoniewski et al. | 252/512 |

*Primary Examiner*—Alan Diamond

[57] ABSTRACT

The application of a treating solution containing polyhydroxy compound and choline chloride to a fibrous cellulosic material is made more uniform and reproducible by including in the treating solution a colorizing amount of a fugitive tint, by which the uniformity of the application can be observed and corrected by appropriate changes to the operating variables.

24 Claims, 1 Drawing Sheet

METHOD AND COMPOSITIONS FOR TREATING FIBROUS CELLULOSIC MATERIALS

CROSS REFERENCE TO RELATED APPLICATIONS

This application is a continuation-in-part of copending U.S. patent application Ser. No. 08/867,132, filed Jun. 2, 1997, which is a continuation-in-part of U.S. patent application Ser. No., 08/738,996, filed Oct. 29, 1996, and now abandoned.

FIELD OF INVENTION

The invention is directed to a method and compositions for treating fibrous cellulosic materials, especially cellulosic fabrics made from cotton and blends of cotton with other fibers such as polyester, nylon, wool, and silk. More particularly, the invention is directed to the treatment of those materials in such manner that both the treating step and subsequent dyeing of the materials are more effective and efficient.

BACKGROUND OF THE INVENTION

Anionic dyes, such as fiber reactive dyes and direct dyes, are currently employed for dyeing cellulose fibers because of their wide shade range, ease of application, and adequate wet fastness properties for many end uses.

There are, however, certain environmental problems related to the utilization of such dyes, which occur because high amounts of electrolyte and alkalinity must be used, and the relatively poor uptake of such dyes into the cellulosic fibers. Depending on the application method, shade depth and dye type, only 50–75% of the dye becomes attached to the substrate using conventional dyeing methods. Consequently, dyehouse effluents contain an unacceptably high level of unfixed dye, electrolytes and alkaline residues which can cause environmental hazards, and compliance problems with EPA discharge standards.

The above-described problems were addressed in part by Weltrowski et al in U.S. Pat. No. 5,501,711 by mildly oxidizing the fibers, subjecting the oxidized fibers to reduction with a solution of chitosan oligomers, stabilizing the chitosan-treated fibers by addition of a reducing agent, such as dimethylol dihydroxyethyleneurea (DMDHEU), and then dyeing the thusly treated fiber. This process involves 4–5 steps, and even then does not address the problems of dye fastness and the high cost of the chitin treatment. This process represents a substantial improvement in dye pickup, and therefore improved dye exhaust from the dye bath. However, the discharge of metals into dye bath effluents remains a particularly troublesome problem, because so many dyes contain substantial quantities of metals. For example, many blue dyes contain copper, and many brown dyes contain chromium. In addition, some dyes contain such metals as cobalt and magnesium.

Traces of catalyst are a still further source of metallic contaminants from dye bath effluents. Furthermore, certain analogs, such as N-3-chloro-2-hydroxypropyltrimethylammonium chloride, may produce toxic amounts of epichlorohydrin when they are contained in alkaline solutions. Therefore, still further improvements were needed to improve dye uptakes, to reduce electrolyte concentrations in the dye bath, and to reduce the quantity and toxicity of the discharge from the dye bath, in each case without sacrificing the dyeability of the cellulose fiber.

Copending U.S. patent application Ser. No. 08/867,132, of which this application is a continuation-in-part, addresses the above-described problems by applying to the cellulosic material an aqueous treating solution comprising (a) a cyclic polyhydroxy compound, (b) choline chloride and (c) a crosslinking catalyst. However, in order for the treatment to be effective it is necessary that the treating solution be applied to the material being treated in a highly consistent manner. The reasons for this are two-fold: (1) to facilitate the uniform application of subsequent treating materials; and (2) to identify and reproduce color and surface effects consistently.

SUMMARY OF THE INVENTION

Therefore, the invention is directed to an improvement on the above-described treating process, which is a continuous method for controlling the application of a uniform coating of a treating solution to a moving web of fibrous cellulose-containing material comprising:

(a) applying the treating solution to at least one surface of a material to effect coloration of the material by the fugitive tint contained in the treating solution, (b) determining the uniformity of the coloration of the treated surface derived from the fugitive tint, and (c) altering the distribution of the treating solution onto the treated surface as may be needed to render the surface of the treated material more uniform, the treating solution comprising by weight, basis total dissolved solids; (1) a heterocyclic polyhydroxy compound selected from the group consisting of dimethyloldihydroxy ethyleneurea, trimethylol melamine, hexamethylol melamine and mixtures thereof; (2) choline chloride, the ratio of (1) to (2) being 0.1–6.0; (3) crosslinking catalyst, the ratio of (1) to (3) being 5–10; and (4) 0.5–1.5% fugitive tint.

In a second aspect, the invention is directed to the above-described method in which the distribution of the treating solution on the treated material is altered by changing one or more operating variables selected from (a) pressure of application rolls on the web, (b) viscosity of the treating solution, (c) temperature of drying, (d) temperature of the treating solution, (e) web speed, (f) drying time of the treated material, (g) pH and (h) combinations of two or more of the operating variables.

In a third aspect, the invention is directed to those compositions which can be used to carry out the above-described methods for treating cellulosic materials.

BRIEF DESCRIPTION OF THE DRAWING

The Drawing consists of a single FIGURE, which is a schematic representation of the method for finishing cellulose-containing fabrics in accordance with the invention.

DEFINITIONS

Figure 1:
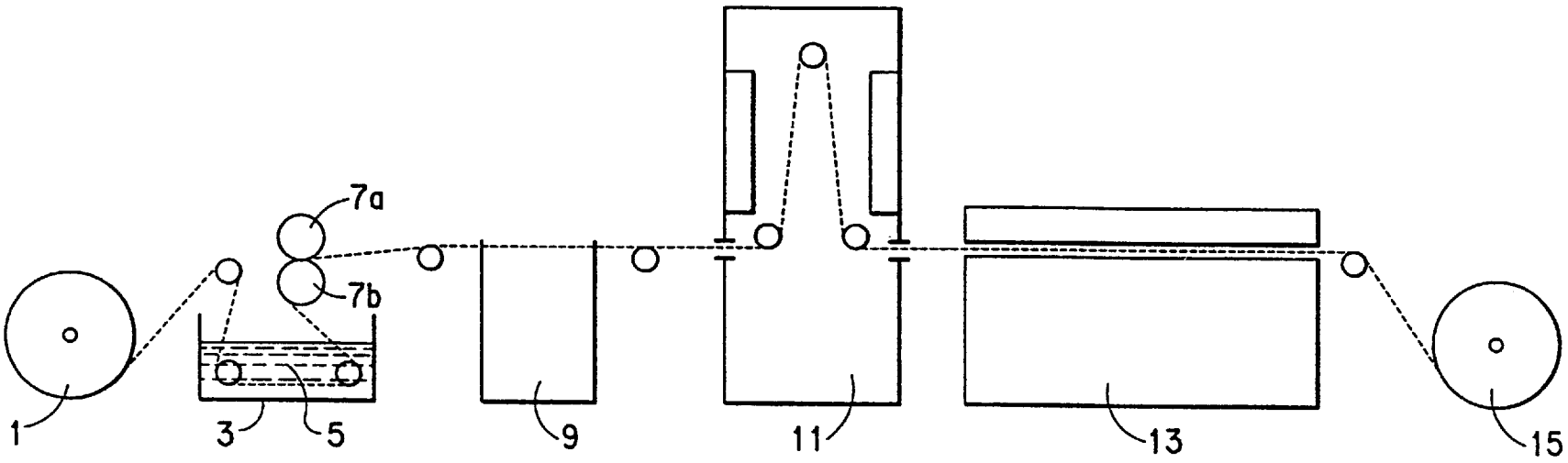

Whiteness is measured by AATCC Test method 110–1889.

As used herein, the following terms have the indicated meanings:

The term "cellulosic fabric" includes cotton, rayon acetate, linen, jute, china grass and blends of fabrics containing at least 60% cellulosic fibers and blends of cotton with polyester, wool, nylon, and rayon.

As used herein, the DMDHEU refers to the compound dimethylol dihydroxyethyleneurea and glycolated or methoxylated analogs thereof.

"K/S" refers to the ratio of the coefficient of absorption (K) to the coefficient of scatter (S) as measured on a fabric by reflectance spectrophotometry. For a particular wavelength of light, the ratio is defined by the Kubelka-Munk function, $K/S=(1-R)/2R$, where R is the reflectance of a sample at the particular wavelength.

The term "dye exhaustion" refers to the percent by weight (% wt.) of dye which has been removed from the initial amount of dye in the dye bath.

The term "owf" means "on the weight of the fiber", basis dry weight of the fiber.

The term "wet out" is a measure of the adsorbency of a fabric, and is defined as the time (in seconds) required for a drop of water placed on the surface of a fabric to disappear by adsorption into the fabric.

The expression "prepared fabric" refers to fabric which has been desized, scoured, bleached, and/or mercerized.

The term "fugitive tint" refers to cationic water-soluble organic dyestuffs or fluorescent whitening agents, which (1) lend a detectable color to aqueous solutions of treating solution in which they are dissolved at concentrations of 0.5–1.5 g/L, but (2) are removable from cellulosic materials treated therewith and from equipment surfaces exposed to such treating solution by rinsing with water, or by removal of aqueous medium in which the fugitive tint is dissolved.

The term "treating solution" refers to the aqueous treating solution referred to hereinabove in the Summary of the Invention and in the claims, the essential components of which, for the purposes of this invention, are (a) heterocyclic polyhydroxy compound, (b) choline chloride, (c) crosslinking catalyst and (d) fugitive tint.

DETAILED DESCRIPTION OF THE INVENTION

As described hereinabove, the invention is directed to a method for controlling more precisely the pretreatment of cellulose-containing materials with a mixture of heterocyclic polycyclic compound and choline chloride. Such careful control is a critical requirement of this method of pretreatment for two reasons: (1) it enables very uniform application of anionic treating materials that may be applied either simultaneously with or subsequent to such pretreatment; and (2) it facilitates repeatable uniformity of the effect of such pretreatment. Such uniformity is, of course, essential with respect to lot-to-lot color uniformity when the treated material is dyed or when special surface effects are obtained.

This capability is achieved in the invention by the use of a fugitive tint in admixture with the aqueous treating solution of heterocyclic polyhydroxy compound and choline chloride. More particularly, the inclusion of fugitive tint in the treating solution results in a visual indication of the uniformity of the treating solution on the treated substrate. That is, any lack of uniformity results in a variation in the intensity of the visual color of the treated area derived from the fugitive tint, which variation is readily observable by the human eye or by appropriate optical sensing devices. Such lack of uniformity can then be corrected by changing one or more operating variables such as roll pressure, viscosity of the treating solution, drying temperature, treating solution temperature, web speed, drying time of the treated material, pH of the treating solution and the like.

Treating Bath Composition: The treating bath for use in the invention (the padder bath in the treatment of fabrics) is comprised of (1) a cationic reactive component, (2) cellulose crosslinking agent, (3) catalyst for the crosslinking agent and (4) a fugitive tint. In the treatment of fabrics, the padding bath may also contain one or more of anionic or nonionic softening agents, a wetting agent, an anti-migration agent, and a nonionic or cationic soil release agent.

It will be recognized that application of the treating composition can be carried out in several other ways. For example, in the case of fabrics, the material can be immersed in the treating solution so it can be applied by means of contact with a kiss roll or an engraved roll. Other liquid coating techniques, such as spraying and printing, can be used as well.

For the purposes of the invention, the cationic reactive agent is choline chloride. It has been observed that the choline chloride reacts chemically with the cyclic polyhydroxy compound, but not with the fiber.

It has been observed that the anionic dye uptake increases as more choline chloride is reacted with DMDHEU. However, in order to balance dye uptake with shrinkage control, it is preferred to use 1–3 parts by weight choline chloride per part by weight DMDHEU.

Though it is not known with certainty, the choline chloride appears to function as a lubricant or softening agent for the fiber. In addition, choline chloride is very resistant to yellowing, and therefore assists in retaining the whiteness of the treated fabric.

The cyclic polyhydroxy compound, of course, serves mainly as a crosslinking agent for the cellulose in the fibers. In that role, it is not essential to attaining high color uptake; however, its use is preferred because of its beneficial effect on reducing shrinkage of the treated fabric.

A further advantage of the invention is that various visual effects can be applied to the fabric. By varying the ratio of polyhydroxy compound to choline chloride, the "heather" and "wash-down look" can be obtained while still retaining good wash, crocking, and light fastness qualities in the fabric. For example, at a ⅙ DMDHEU/choline chloride weight ratio and 0.5% wt. catalyst, a 65–70% dyestuff "washdown" can be obtained. On the other hand, at about ½ wt. ratio, the dyed fabric is color fast.

For pretreatment and printing applications, at least 25 g/L cyclic polyhydroxy compound is needed in the treating bath to obtain shrinkage control. At least 40 g/L cyclic polyhydroxy compound is preferred. However, more than 135 g/L cyclic polyhydroxy compound is not desired, lest the tensile strength of the materials be lowered. It is interesting to note that the choline chloride mitigates the adverse effect of higher concentrations of the cyclic polyhydroxy materials. Therefore, they can be used in high amounts. However, for co-applications other than printing, only 10–25 g/L of cyclic polyhydroxy compound is needed for treating white goods and 7.5–45 g/L is preferred for treating dyed goods.

For best results throughout, the weight ratio of polyhydroxy compound to choline chloride need be only 0.1–6. It is preferred to use at least 10 g/L choline chloride in the padder bath, but no more than 135 g/L should be used in order to avoid any adverse reaction of the choline chloride with the polyhydroxy compound.

An essential component of the padder bath is the crosslinking catalyst which brings about crosslinking of the cellulose in the fabric. Suitable crosslinking catalysts for use in the treating bath are acid catalysts such as magnesium chloride, zinc nitrate, aluminum sulfate, and mixtures thereof. For co-applications other than printing, only 1.5–4 g/L catalyst is required for treating white goods and 1.5–7.5 g/L for treating dyed goods. However, for pretreatments and co-applications by printing, it is preferred to use 5–7.5 g/L.

However, no more than 7.5 g/L, and preferably no more than 6 g/L of catalyst should be used. The reason for this is that excess catalyst incurs hydrolysis of the cellulose, which results in loss of fabric tensile strength. It is interesting to note that at equivalent levels of catalyst, the intensity of color upon dyeing is enhanced by higher levels of choline chloride.

Though the innovative method as described and claimed in copending U.S. patent application Ser. No. 08/867,132 is quite effective for the treatment of cellulosic materials, consistency and assurance of its effectiveness are obtained in accordance with this invention by the inclusion of a very small amount of a fugitive tint in the treating solution.

There are two basic properties of the fugitive tint, which are essential to their use in the invention: (1) they must be cationic or nonionic and (2) they must be completely soluble in water at all processing conditions. These properties are essential in order that the tint have negligible affinity to the surface of the cellulosic substrates being treated; and the complete water solubility is essential in order that the fugitive tint can be removed from the treated surface with aqueous media. Thus, the fugitive tints can be removed by separating the treated surface from the aqueous treating solution in which they are dissolved. The dual properties of complete removability and water solubility are both essential to their successful use in the invention.

So long as the fugitive tint meets the above-named two essential criteria, almost all basic (cationic) dyes are potential candidates for use in the invention as fugitive tints, based on their compatibility with choline chloride. In this regard, reference is made to pages 84–87 of the July, 1997 issue of the AATCC Buyer's Guide in which is presented an exhaustive list of commercially available basic dyes. List is arranged by color classification.

In all cases, it is preferred to use the lowest concentration of fugitive tint which will impart a clearly detectable color to the treating solution and to the surface of the cellulosic material being treated. In practice, it has been found that a concentration of about 0.5 g/L of fugitive tint in the treating solution is adequate. On the other hand, the use of higher concentrations of fugitive tint than are necessary should be avoided since the intense coloration produced therefrom makes removal of the color more difficult.

Different colors of fugitive tints can be used for different applications. Furthermore, blends of fugitive tints of different colors can be used to provide different depths and shades of color.

Fluorescent whitening agents used in the treatment of white goods do not impart a color to the treating solution that is visible to the human eye. However, they do impart a color change that is visible under fluorescent lights. Therefore, within the context of this invention, such whitening agents function in an analogous manner to dyestuffs.

While the cyclic polyhydroxy compound, choline chloride, catalyst, and fugitive tint are the essential components of the treating solution, other materials may be added to bring about particular changes in the physical properties of the treating bath.

For example, the migration of dye from the fibers of the fabric may occasionally be a problem. This is, in large part, the result of low viscosity of the padding bath. Therefore, since the padding bath of the invention may not contain any significant amount of dissolved polymer, it will frequently be desirable to raise the viscosity of the padder bath by either of two alternative procedures. The first way to increase viscosity of the bath is to reduce the water content. This can be done by applying a vacuum to the fabric emerging from the squeeze rolls on the outlet of the padding bath. The second procedure is to add a water-soluble polymer to the padding bath. It will be recognized that both methods of increasing viscosity can be used together. Suitable polymers for this purpose include poly(acrylic esters), block copolymers of mannuronic and guluronic acids.

Soil release agents are not usually needed for cotton fabrics. They will, however, be needed for high polyester/cotton blends. When they are used in the invention, suitable soil release agents include such materials as polyethyleneglycols, copolymers of methacrylic acid and ethylacrylate, and fluoroacrylic polymers. However, such materials must be either nonionic or cationic in order to avoid coagulation.

Other additives which may be used with the invention in the padding bath include anionic or nonionic fabric softening agents and anionic or nonionic wetting agents. Suitable softening agents include nonionic fatty glycerides and polyethylene emulsions. Suitable wetting agents are nonionic detergents, such as ethoxylated linear alcohol hydrophobe-$C_{12-13}$, and the reaction product of 2,6,8-trimethyl-4-nonanol and ethylene oxide. Such materials are well known in the finishing art, and can be used with the invention in a manner similar to their use in conventional non-cationic finishing processes.

In the absence of the catalyst, the primary components of the treating solution are stable and do not undergo significant reaction when the solution is stored at ambient temperatures. Thus, aqueous solutions of the cyclic polyhydroxy compounds and choline chloride can be prepared in advance for later use by omitting the catalyst. Such premixed compositions are comprised of (a) cyclic polyhydroxy compounds, (b) choline chloride, (c) fugitive tint, and the remainder (d) is water. The weight ratio of (a) to (b) should be within the range of 0.1–6, which corresponds to the useful proportions of these components in the treating bath. However, the concentration of those active components in the solution can vary widely. Though small solution concentrations can be used, more concentrated solutions are more economical. Thus, it is preferred that the active components be at least 40% by weight and preferably 70% by weight or even higher. It is preferred that the concentration of active components not exceed about 80%.

It will be recognized that, within the above-noted broad compositional parameters, narrower ranges of compositions for the treating solution will be preferred for many applications.

The most efficient method for removing the fugitive tint from the treated material and from the surfaces of the equipment used for its application is simply washing the treated material with water, preferably unheated water. That is, after successful application of the treating solution to the cellulosic material and removal of the treated material from the treating solution, then wash the material with cold water. Because of the low viscosity of the treating solution and the high solubility of the fugitive tints in water, it is not necessary to heat the rinsing water to obtain adequate removal of the fugitive tint color from the treated surfaces. It will be recognized that visibility to the human eye is most important in the practice of the invention; nevertheless various optical instruments may be used to discern color variations in the treatment of cellulosic materials for purposes of the invention (e.g., the use of a fluorescent lamp to detect fluorescent whitening agent).

Finishing Operating Variables: In the finishing operation, the fabric must have a wet pickup of at least 50% weight and my be as high as 95%. Drying is carried out at 225–250 F. (107–121 C.), and curing is carried out at 300–365 F. (149–185 C.). In this process, the fabric will typically pick up 3–8%, basis dry weight, of the finishing chemicals.

The curing time and temperature used in the procedure of the invention will, of course, vary in accordance with the physical properties of the fabric. Thus, they will be different for different fiber blends. On the whole, higher curing temperatures will require shorter curing times. However, some fabric blends are more sensitive to thermal degradation. For example, the curing temperature of wool blends should be kept well below 350 F. (177 C.), preferably below 330 F. (166 C.), in order to avoid damage to the woolen fibers. A temperature of about 325 F. (163 C.) is still further preferred. For cellulosic fabrics sensitive to yellowing, a temperature as low as 300 F. (149 C.) for 8–16 minutes may be even further preferred.

It is preferred in the practice of the invention to remove substantially all of the water before curing the fabric. Therefore, it is preferred to dry the fabric at a lower temperature in order that premature crosslinking, which would impede water removal, does not take place. Thus, during drying, the fabric temperature should not exceed 275 F. (135 C.), and preferably no higher than 250 F. (122 C.). However, during the crosslinking step, the fabric temperature can be raised to as high as 365 F. (185 C.), provided the curing temperature does not exceed the thermal degradation temperature of any blended fiber contained in the fabric.

As mentioned above, the drying and curing steps are a function of both time and temperature. The higher the temperature, a shorter time is needed for drying and curing. For example, during curing of the padded fabric, if a temperature of 320 F. (160 C.) is used, then the curing time should be about 4–6 minutes to cure the fabric completely. On the other hand, if a temperature of 365 F. (185 C.) is used, only about 90 seconds is needed.

It will be recognized by those skilled in the art that it is necessary to heat set polyester/cotton fabric blends. This function can, of course, be carried out after mercerization, before padding or before dyeing. However, an advantage of the invention is that the heat setting is carried out fully during the curing step of the process. Thus, neither additional steps, nor additional equipment are required to achieve the heat setting of such synthetic fiber/cotton fabric blends.

When the fabric being treated by the process of the invention is to undergo dyeing, it is essential that the fabric be prepared in order to avoid interference with the uptake of the dye into the fabric.

Dye Bath Composition: An important feature of the padding step of the invention is that it does not require any particular operational changes in the subsequent dye bath. Thus, the fabric/liquor ratio (F/L) will usually be within the range of 1:5–1:40, and conventional dye bath temperatures will be used, for example, 60 C. to 115 C. (140–239 F.). All anionic dyes can be used in dyeing fabrics which have been tested in accordance with the invention. However, the dyes listed in Table 1 are preferred.

TABLE 1

SELECTED ANIONIC DYESTUFFS FOR CATIONIC FINISHING (5 is Best)

| Dye Type | Dyestuff | % Dye Depth Over Regular Dye | II A Wash | Wet/Dry Crocking | Light fastness 20 hrs./40 hrs. |
|---|---|---|---|---|---|
| Acid | Acidol B. Yellow M-5GL | | 4 | 4/5 | 5/5 |
| | Acidol Yellow M-5RL | | 5 | 4/5 | 5/5 |
| | Acidol Yellow M-2GLN | | 5 | 4/5 | 5/5 |
| | Acidol Orange M-RL | | 5 | 4/5 | 5/5 |
| | Acidol Scarlet M-L | | 5 | 3/4 | 5/5 |
| | Acidol B. Blue M-50 | | 5 | 3/4 | 5/5 |
| | Acidol Dark Blue M-TR | | 5 | 3/4 | 5/5 |
| | Acidol Green M-FOL | | 5 | 3/4 | 5/5 |
| | Acidol Brown KM-N | | 5 | 3/4 | 5/5 |
| Acid | Acidol Black M-SRL | | 5 | 5/4 | 5/5 |
| | Palantin Fast Yellow GRN 200% | | 5 | 3/4 | 5/5 |
| | Palantin Fast PinkBNT | | 5 | 3/4 | 5/5 |
| Reactive | Basilen Yellow F3RM | 90% | 5 | 4/5 | 4/4 |
| | Basilen Yellow E-3G | 5 | 30% | 5 | 4/4 |
| | Basilen Red FRM | 170% | 5 | 5 | 5/4 |
| | Basilen Red F-3BM | 80% | 5 | 5 | 5/4 |
| | Basilen Blue E-BGF | 80% | 5 | 5 | 3/2 |
| | Basilen Blue E-RFN | 10% | 5 | 5 | 3/2 |
| | Basilen Blue | 30% | 5 | 5 | 5/4 |

TABLE 1-continued

SELECTED ANIONIC DYESTUFFS FOR CATIONIC FINISHING (5 is Best)

| Dye Type | Dyestuff | % Dye Depth Over Regular Dye | II A Wash | Wet/Dry Crocking | Light fastness 20 hrs./40 hrs. |
|---|---|---|---|---|---|
| | FKN Basilen Brown E-RA | 70% | 5 | 5 | 3/2 |
| | Basilen Golden Yellow E-2R | 20% | 5 | 5 | 5/2 |
| | Cibracron Yellow LS-R | 15% | 5 | 4/5 | 5/5 |
| | Cibacron Scarlet LS-2G | 50% | 5 | 4/5 | 5/5 |
| | Cibacron Orange LS-BR | 40% | 5 | 4/5 | 5/4 |
| | Cibacron Red LS-B | 50% | 5 | 5/3 | 5/4 |
| Reactive | Cibacron Blue CR | 10% | 5 | 4/5 | 4/3 |
| | Cibacron Blue LS-3R | 40% | 5 | 3/4 | 5/4 |
| | LANASET Yellow 2R | | 5 | 4/5 | 4/4 |
| | LANASET Red 2B | | 5 | 4/5 | 4/4 |
| | LANASET Blue 2R | | 5 | 4/5 | 4/4 |
| | Sumafix Yellow 4GL | 40% | 5 | 5/4 | 5/5 |
| | Reinazol Red 3BS | 50% | 5 | 5/4 | 4/3 |
| | Sumafix Blue R | 80% | 5 | 5/4 | 5/4 |
| | Remazol B. Violet 5R | 70% | 5 | 5/4 | 4/3 |
| Direct | Superlight Fast Blue RL | 80% | 4 | 5/4 | 5/5 |
| | Superlight Fast Rubine WLKS | 150% | 3 | 3/4 | 5/5 |
| | Superlight Orange EGLL | 80% | 4 | 5/4 | 5/5 |
| | Superlight Fast Yellow EFC | 30% | 4 | 5/4 | 5/5 |
| | Intralight B. Blue L | 40% | 4 | 4/5 | 5/5 |
| Direct | Intralight Fast Blue NBLL | 40% | 4 | 5/4 | 5/5 |
| | Intralight Fast Blue FGL | 43% | 4 | 4/5 | 5/5 |

In the above Table 1, the dyes and their sources are identified by the following registered trademarks:

| Trademark | Proprietor |
|---|---|
| Acidol | Badische Anilin & Soda Fabrik A.G.(BASF) Ludwigshafen/Rhine, FRG |
| LANASET | CiBA Geigy Corp. New York, New York |
| Basilen | BASF |
| Cibacron | Ciba-Geigy Corporation New York, NY |
| Intralight | Crompton & Knowles Corporation New York, NY |
| Palantin | BASF |
| Remazol | Hoechst, A.G. Franfurt/Main, FRG |
| Sumafix | Mitsubishi K.K., Tokyo, Japan |
| Superlight | Crompton & Knowles Corporation |

In addition to the dyes discussed above, sulfur, vat and azoic dyestuffs can be used for the coloration of fabrics which have been treated in accordance with the invention. Sulfur and vat dyes are anionic in their leuko form and the azoic dyes are anionic due to the presence of sulfonic salt groups in the molecule.

Dye Bath Operating Variables: The dye bath in which the prepared fabric is colored will usually contain water, dye, leveling agent, wetting agent, and defoamer.

For use with anionic dyestuffs, such as those used in this invention, the wetting agents must be nonionic or anionic. Polyethylene glycol (mono-octylphenyl) ether is useful for this purpose.

In the course of agitation, such as that which is encountered in jet dyeing, a microfoam may be produced. Such foaming can be eliminated by addition to the dye bath of a small amount of nonionic defoaming agent, such as 0.1–0.2% wt. silicone polymer.

To moderate the dye exhaustion rate, it will frequently be desired to add to the dye bath a small amount of a leveling agent. These materials form an intermediate complex with the dyestuff which facilitates migration of unfixed dyestuff to less concentrated areas.

While the proportions of these essential components will vary widely according to the fabric, the exact nature of the finishing treatment and the dye composition, they will normally be present in the following proportions, owf:

| | |
|---|---|
| Dye | 0.1–4% |
| Leveling Agent | 1–3% |
| Wetting Agent | 0.1–1.0% |
| Defoamer | 0.1–0.3% |

A still further critical operating variable in the dye bath is the fabric/liquor weight ratio, which will usually be within range of 1:5 to 1:40. Dye bath temperatures will be at least 150 F. (66 C.), and preferably 200–205 F. (93–96 C.). The time within the dye bath will usually be a function of the degree of dye uptake which is desired. It is, of course, a major advantage of the invention that the time required to attain high dye exhaust levels is greatly reduced.

Referring now to FIG. 1, the treatment of cellulosic fabrics in accordance with the invention will ordinarily be carried out in the following continuous manner:

The previously prepared (desized, bleached and mercerized) fabric to be pre-treated is provided on fabric feed roll 1 from which it is drawn to padder 3, comprising a trough and two squeeze rolls. The padder 3 contains a bath of cationic treating solution 5, through which the fabric is passed, and adsorbs a quantity of treating solution. Emerging from the treating bath, the fabric is passed between squeeze rolls 7*a* and 7*b* to remove excess treating solution from the fabric. The fabric, containing both unbonded and adsorbed treating solution, is passed from the squeeze rolls 7*a* and 7*b* to vacuum slot extractor 9, in which the fabric is subjected to the force of a vacuum from below to remove unbonded treating solution contained in the fabric. The fabric leaving the vacuum slot extractor 9 contains about 50% owf treating solution. From vacuum slot extractor 9, the fabric is passed to pre-drier 11, in which the fabric is heated uniformly on both sides to a temperature of at least 250 F. (121 C.) to effect removal of unbonded water down to a level of 15–20% owf. Equipment temperatures as high as 315 F. (157 C.) are frequently used for this purpose. It is, of course, necessary to retain at least 5% weight moisture in the fabric in order to maintain an adequate degree of fiber swelling, which is needed to control stretchability of cellulosic fabric. It is preferred, however, that the fabric entering the tenter contain no more than about 20% weight water in order to make the process more efficient. A moisture level of 10–15% is preferred. It is noted that the most desirable moisture content for the fabric will vary according to the kind of a fabric being treated, and the extent of the pretreatment. The heated fabric is removed from the pre-drier 11 and passed to enclosed tenter 13, in which the fabric is placed on tenter pins to apply to the fabric a bi-directional tensile stress. The thusly supported fabric is then subjected to heating on both sides of the fabric by heated air, and the temperature of the fabric is raised to a level of 250–365 F. (121–185 C.). The speed of the fabric through the tenter 13 is about 50–100 yards/min. (45.7–68.6 m/min.). It is necessary to cool down the fabric as it leaves the tenter and before it is rolled up in order to minimize further chemical reactions in the fabric while it is rolled. Therefore, at the downstream end of the tenter, the fabric is air cooled to about room temperature, and the fabric is wound on fabric storage roll 15 before subsequent dyeing. Upon leaving the cooling section of the tenter, the water content of the fabric is in approximate equilibrium with the cooling air, e.g. about 8–10% weight. The fugitive tint is subsequently removed in the dye bath.

The method of the invention has many different methods of application for the treatment of cellulose-containing materials. For example, the invention is quite useful for the pretreatment of prepared fabrics to be dyed and white goods to change the surface properties of those materials. Thus, woven and non-woven fabrics, yarns, warps and goods to be printed can be treated in accordance with the invention in either a batch or continuous manner prior to subsequent dyeing. Likewise, the method of the invention can be used to treat such materials simultaneously with the dyeing step.

A further use of the invention is the treatment of prepared cellulose-containing materials to produce unique surface effects on the goods. For example shrink resistance, seersucker appearance and pucker effect.

Thus, it will be recognized that the treating solution can be applied to the fabric by techniques other than padding, such as roll coating, using either engraved rolls or kiss rolls. The treating solution can be applied to one or both sides of the fabric by the use of one or two rolls respectively.

When the treating solution is applied by padding (by immersion) the capacity of the treating solution will usually be higher than when it is applied by roll coating. Thus the concentration of the ingredients of the treating solution must be higher for roll coating.

An important variable in the padding and dyeing of fabrics is the effect of the padding bath on the whiteness of the fabric. The fabric being prepared by the invention is preferred to have a whiteness of at least 60 in order to assure consistent color. An important advantage of the invention is that it has no detrimental effect on the whiteness of the treated fabric. In fact, the use of choline chloride in the padding step appears to reduce the yellowing caused by other components of the padding bath. Catalysts and polymers are frequently troublesome in this regard. Therefore, when desired, the whiteness of the fabric can be retained at a level of 80–90 by merely adjusting the residence time and temperature of the fabric within the tenter. In particular, by lowering the temperature and/or residence time within the tenter, the degree of whiteness can be retained at such higher levels.

The invention is, of course, useful for treating woven, non-woven and knitted fabrics and gray goods made therefrom, as well as thread and yarn for use in making fabrics. In addition, the invention can be used for the treatment of other substrates containing cellulosic fibers, such as wood pulp, and paper.

When the invention is applied to the treatment of paper, it can be carried out in any of three different places in the paper manufacturing process. That is, the treating solution can be added to the process before sheet formation at either the beater or the head box. However, the treating solution can also be applied to the paper after sheet formation in a manner analogous to the treatment of fabrics as described above. The composition of the treating solution for use in treating paper will be in the same range that is used for the treatment of fabrics by padding.

As discussed hereinabove, the operating parameters of the invention very substantially, depending on the particular method of applying the treating solution. Table 2 below is summary of the operating parameters for the different modes of application.

TABLE 2

Operating Parameters as a Function of the Method for Applying the Treating Solution

| | | PRETREATMENT | | CO-APPLICATION | | |
|---|---|---|---|---|---|---|
| COMPONENT | UNITS | Padding | Printing | Padding* | Padding** | Printing |
| Choline Chloride | g/L | 55–85 | 55–85 | 20–45 | 55–85 | 55–85 |
| DMDHEU | g/L | 7.5–45 | 25–45 | 10–25 | 7.5–45 | 25–45 |
| Catalyst | g/L | 1.5–7.5 | 5–7.5 | 1.5–4 | 1.5–7.5 | 5–7.5 |
| DMDHEU/Catalyst Ratio | — | 5–10 | 5–10 | 5–10 | 5–10 | 5–10 |
| DMDHEU/Choline Chloride Ratio | — | 0.1–6 | 0.1–6 | 0.1–6 | 0.1–6 | 0.1–6 |
| Fugitive Tint | g/L | 0.5–1.5 | 0.5–1.5 | — | 0.5–1.5 | 0.5–1.5 |
| Fluorescent Whitening Agent | g/L | — | — | 1–10 | — | — |
| Wetting Agent | g/L | 1–2 | 1–2 | 1–2 | 1–2 | 1–2 |
| Antimigration Agent | g/L | 10–50 | 0–50 | 10–50 | 10–50 | — |
| Gum Thickener | g/L | — | 0–200 | — | — | 10–200 |
| Anionic Dyestuff (Powder or Liquid) | g/L | — | — | — | 0–150 | 0–150 |
| Buffer (To pH Range) | pH | 5.0–7.0 | 5.0–8.0 | 5.0–7.0 | 5.0–6.5 | 5.0–8.0 |
| | OPERATING CONDITIONS | | | | | |
| Drying - Fabric Temperature | °F. | 225–250 | 225–250 | 225–250 | 225–250 | 225–250 |
| Drying-Time | Seconds | 240–120 | 240–120 | 240–120 | 240–120 | 240–120 |
| Curing - Fabric Temperature | °F. | 310–365 | 310–365 | 300–325 | 310–365 | 310–365 |
| Curing-Time | Seconds | 600–60 | 600–60 | 60–40 | 600–60 | 600–60 |

*White Goods
**Dyed Goods

In each of the above-described modes of operation, the aqueous treating solution contained 2–35%wt. dissolved solids and had a pH of 3.5–8.

In Table 2, all quantities of the listed components are given as the actual weight of the component in the treating solution (g/L), irrespective of what the concentration of the component may have been in the aqueous solution by which it was added. However, the indicated weights of the fugitive tints, dyestuffs and fluorescent whitening agent are the weight of the as-received aqueous composition, not merely the primary component. For example, the indicated dyestuffs, including the fugitive tints, are typically comprised, by weight, of about 10–20% crude dye and 80–90% additives such as salt, dispersing agent, anti-coagulant, anti-humidity agent and anti-dusting agent.

EXAMPLES

Example 1

An aqueous solution for the pre-treatment of cotton fabric (100% cotton twill) to obtain maximum yield and dye fastness is prepared having the following composition:

| Active Component | Concentration of Active Component | Wt. Of Active Component/Vol. Of Treating Solution |
|---|---|---|
| Choline chloride | 70 | 50–85 |
| DMDHEU | 70 | 25–45 |
| Catalyst | 25 | 5–7.5 |
| Wetting agent | 100 | 1–2 |
| Antimigration agent | 40 | 10–50 |
| Fugitive tint | 25 | 0.5–1.5 |

The above-described treating solution, in which the weight ratio of choline chloride to DMDHEU is 2:1, is placed in a padding bath through which a prepared cotton fabric is passed continuously through a series of treating rolls. As the fabric passes through the padding bath, wet pickup of treating solution onto the fabric is 65–85% owf. Upon leaving the padding bath, the fabric is dried in a gas fired or infrared drier at 250 F. for 2–3 minutes, thus leaving 15–20% wt. treating composition on the thusly treated fabric. After drying, the treated fabric is cured at 345–365 F. for 90–60 seconds, after which the fabric bearing the cured coating is passed to a garment dyeing operation in which the dyed fabric is washed with cellulase enzyme at 45–60 C., pH 4–5. This improves fabric appearance rating and wash fastness.

Example 2

An aqueous solution is prepared for the pre-treatment of cotton fabric to obtain upon dyeing a heather effect for use of the fabric in indigo blue jeans. The treating solution has the following composition:

| Active Component | Concentration of Active Component | Wt. Of Active Component/Vol. Of Treating Solution |
|---|---|---|
| Choline chloride | 70 | 50–85 |
| DMDHEU | 70 | 7.5–15 |
| Catalyst | 25 | 5–7.5 |
| Wetting agent | 100 | 1–2 |
| Antimigration agent | 40 | 10–50 |
| Fugitive tint | 25 | 0.5–1.5 |

The above described treating solution, in which the weight ratio of choline chloride to DMDHEU is 6–8:1, is placed in a padding bath through which a prepared cotton fabric (100% cotton twill) is passed continuously through a series of treating rolls. As the fabric passes through the padding bath, wet pickup of treating solution on the fabric is 50–95% owf. Upon leaving the padding bath, the fabric is dried in a pre-drier at 250 F. for 2–3 minutes, thus leaving 15–20% wt. treating solution on the thusly treated fabric. After drying, the treated fabric is cured at 325–340 F. for 60 seconds, after which the pre-treated fabric, coated with the cured treating composition, is passed to a garment dyeing operation, after which dyed fabric is washed with cellulase enzyme. Dye pickup on the fabric is 2–3% owf.

Example 3

An aqueous solution is prepared for the pretreatment of 100% cotton twill fabric to obtain a high degree of whiteness in the fabric upon subsequent treatment with an optical brightener. The composition of the treating solution is as follows:

| Active Component | Concentration of Active Component | Wt. Of Active Component/Vol. Of Treating Solution |
|---|---|---|
| Choline chloride | 70 | 20–45 |
| DMDHEU | 70 | 10–25 |
| Catalyst | 25 | 5–7.5 |
| Wetting agent | 100 | 1–2 |
| Fluorescent Whitening Agt | 100 | 1–10 |

The above-described treating solution, in which the weight ratio of choline chloride to DMDHEU is 2:1, is placed in a padding bath through which the prepared cotton fabric is passed continuously through a series of treating rolls. As the fabric passes through the padding bath, wet pickup of treating solution on the fabric is 65–85% owf. Upon leaving the padding bath, the fabric is dried in a pre-dryer at 250 F. for 2–3 minutes, leaving 10–20% wt. treating solution on the treated fabric. After drying, the treated fabric is cured at 300–340 F. for 120–60 seconds.

What is claimed is:

1. A continuous method for controlling the application of a uniform coating of a treating solution to a moving web of fibrous cellulose-containing material comprising:

(a) continuously applying a treating solution containing a fugitive tint to at least one surface of the material to effect coloration of the surface to which the treating solution is applied;

(b) determining the uniformity of the coloration of the treated surface;

(c) altering the distribution of the treating solution onto the treated surface to render the surface coloration of the treated material more uniform, the treating solution having dissolved therein (1) a heterocyclic polyhydroxy compound selected from the group consisting of dimethyldihydroxy ethyleneurea, dimethyloldihydroxy ethyleneurea, trimethylol melamine, hexamethylol melamine and mixtures thereof, (2) choline chloride, the weight ratio of (1) to (2) being 0.1–6.0, (3) crosslinking catalyst, the weight ratio of (1) to (3) being 5–10, and (4) 0.5–1.5 g/L fugitive tint; and (d) decolorizing the applied coating of treating solution by removing the fugitive tint therefrom in an aqueous medium.

2. The method of claim 1 in which the distribution of the treating solution on the treated material is altered by changing at least one operating variable selected from (a) pressure of application rolls on the web, (b) viscosity of the treating solution, (c) temperature of drying, (d) temperature of the treating solution, (e) web speed, (f) drying time of the treated material, and (g) pH.

3. The method of claim 1 in which the fibrous cellulose-containing material is a prepared fabric selected from cotton, rayon, acetate, blends of cotton and rayon, linen, jute, china grass and blends of at least 50% wt. cotton with a non-cellulosic natural or synthetic fiber.

4. The method of claim 3 in which the cellulose-containing material is a prepared fabric containing at least 60% wt. cotton.

5. The method of claim 1 in which the fibrous cellulose-containing material is paper.

6. The method of claim 1 in which the treating solution contains 55–85 g/L choline chloride, 24–45 g/L heterocyclic polyhydroxy compound, 5–7.5 g/L catalyst, 1–2 g/L wetting agent, 10–50 g/L anti-migration agent and 0.5–1.5 g/L fugitive tint.

7. The method of claim 6 in which wet pickup of the treating solution is 50–95% owf, drying is carried out at about 250 F. for 2–3 minutes and crosslinking of the heterocyclic polyhydroxy compound with the cellulose and reaction with the choline chloride is carried out at 320–365 F. for 120–90 seconds.

8. The method of claim 1 in which the treating solution contains 55–85 g/L choline chloride, 10–25 g/L heterocyclic polyhydroxy compound, 3–7.5 g/L catalyst, 1–2 g/L wetting agent, 10–50 g/L anti-migration agent and 0.5–1.5 g/L fugitive tint.

9. The method of claim 8 in which wet pickup of the treating solution is 50–95% owf, drying is carried out at about 250 F. for 2–3 minutes and crosslinking of the heterocyclic polyhydroxy compound with the cellulose and reaction with the choline chloride is carried out at 320–340 F. for 60–45 seconds.

10. The method of claim 1 in which the treating solution contains 55–85 g/L choline chloride, 10–25 g/L heterocyclic polyhydroxy compound, 3–7.5 g/L catalyst, 1–2 g/L wetting agent, 30–50 g/L anti-migration agent and 0.5–1.5 g/L fugitive tint.

11. The method of claim 1 in which the treating solution contains 20–45 g/L choline chloride, 10–25 g/L heterocyclic polyhydroxy compound, 5–7.5 g/L catalyst and, 1–2 g/L wetting agent.

12. The method of claim 11 in which wet pickup of the treating solution is 65–85% owf, drying is carried out at 225–250 F. for 2–5 minutes and crosslinking of the heterocyclic polyhydroxy compound with the cellulose and reaction with the choline chloride is carried out at 300–325 F. for 90–60 seconds.

13. The method of claim 1 wherein the treating solution is printed on one side only of 100% cotton fabric to obtain differential shrinkage effects.

14. An aqueous composition, which upon the addition of crosslinking catalyst, is useful for changing the surface properties of fibrous cellulose-containing material comprising by weight, basis total dissolved solids, (1) a heterocyclic polyhydroxy compound selected from the group consisting of dimethyloldihydroxy ethyleneurea, trimethylol melamine, hexamethylol melamine and mixtures thereof; (2) choline chloride, the ratio of (1) to (2) being 0.1–6.0; and (3) 0.5–1.5% fugitive tint.

15. An aqueous composition useful for changing the surface properties of fibrous cellulose-containing materials comprising (1) heterocyclic polyhydroxy compound, (2) choline chloride, the weight ratio of (1) to (2) being 0.1–6, (3) crosslinking catalyst, the weight ratio of (1) to (3) being 5–10, and (4) 0.1–1.5 g/L fugitive tint.

16. The composition of claim 14 or 15, which contains 55–85 g/L choline chloride and 25–45 g/L cyclic polyhydroxy compound.

17. The composition of claim 14 or 15, which contains 20–45 g/L choline chloride and 10–25 g/L cyclic polyhydroxy compound.

18. The composition of claim 14 or 15, which contains 55–85 g/L choline chloride and 7.5–15 g/L cyclic polyhydroxy compound.

19. The composition of claim 14 or 15 in which composition is comprised by weight of 98–65% water and 2–35% dissolved solids.

20. The composition of claim 14 or 15 which contains a pH adjustment compound in an amount to adjust the hydrogen ion concentration of the composition to within the range of pH 3.5–8.0.

21. The composition of claim 20 in which the pH adjustment compound is used to adjust the pH of the composition to within the range of pH 5.5–6.8.

22. The composition of claims 14 or 15 which also contains dissolved therein 0.1–1.5% non-anionic wetting agent.

23. The composition of claim 14 or 15 which also contains dissolved therein 1–10 g/L fluorescent whitening agent.

24. The composition of claim 14 which also contains dissolved therein 10–50 g/L anti-migration agent.

* * * * *